US008235870B2

(12) United States Patent
Hamilton

(10) Patent No.: US 8,235,870 B2
(45) Date of Patent: Aug. 7, 2012

(54) METHOD AND APPARATUS FOR INTEGRATING PHYSICAL EXERCISE AND INTERACTIVE MULTIMEDIA

(75) Inventor: Bobbi Hamilton, Santa Monica, CA (US)

(73) Assignee: Phresh, LLC, Santa Monica, CA (US)

( * ) Notice: Subject to any disclaimer, the term of this patent is extended or adjusted under 35 U.S.C. 154(b) by 0 days.

(21) Appl. No.: 13/245,519

(22) Filed: Sep. 26, 2011

(65) Prior Publication Data

US 2012/0015334 A1 Jan. 19, 2012

Related U.S. Application Data

(63) Continuation-in-part of application No. 12/541,908, filed on Aug. 14, 2009, now Pat. No. 8,025,606.

(60) Provisional application No. 61/089,400, filed on Aug. 15, 2008.

(51) Int. Cl.
*A63B 71/00* (2006.01)

(52) U.S. Cl. ..... 482/4; 482/1; 482/148; 434/247

(58) Field of Classification Search ..... 482/1–9, 482/148, 900–902; 434/247, 428
See application file for complete search history.

(56) References Cited

U.S. PATENT DOCUMENTS

| | | | | |
|---|---|---|---|---|
| 5,464,946 | A | 11/1995 | Lewis | |
| 5,949,951 | A | 9/1999 | Sklar et al. | |
| 6,050,822 | A | 4/2000 | Faugh | |
| 7,063,535 | B2 | 6/2006 | Stamm et al. | |
| 7,108,635 | B2 | 9/2006 | Howlett-Campanella | |
| 7,158,676 | B1 | 1/2007 | Rainsford | |
| 7,401,100 | B2 | 7/2008 | Jung et al. | |
| 7,465,263 | B1 * | 12/2008 | Conrad et al. | 482/148 |
| 2001/0034288 | A1 | 10/2001 | Howlett-Campanella | |
| 2007/0252327 | A1 | 11/2007 | Ueshima et al. | |
| 2008/0096183 | A1 * | 4/2008 | Cotran et al. | 434/428 |
| 2008/0139307 | A1 | 6/2008 | Ueshima et al. | |

(Continued)

FOREIGN PATENT DOCUMENTS

EP 0 823270 A1 8/1997

(Continued)

OTHER PUBLICATIONS

Non-Final Office Action for U.S. Appl. No. 12/541,908, dated Dec. 30, 2010.

(Continued)

*Primary Examiner* — Glenn Richman
(74) *Attorney, Agent, or Firm* — Risso & Associates

(57) ABSTRACT

A physical exercise apparatus comprises a mat/cushion device and accessories designed for fitness interactivity using an array of variations of graphics specifically placed on the mat. The locations of the graphics are provided as an aid to guide proper body positions or postures, placement and alignment in yoga and physical exercise, and for the use of creative sequencing of movement, proper technique, and body mechanics. The apparatus is a foundation and map for physical exercise programs, games, interactive play, physical therapies and methods. The apparatus contains graphics with anthropometric measurements that may be synchronized with instruction, audio and/or video displays, and/or video games containing and delivering corresponding graphics for body placement and timing. The method through instruction and gaming can be delivered auditorially and/or visually, through interactive multimedia systems, on a timed and/or touch sensitive system, as well as an array of different technologies such as the internet.

19 Claims, 9 Drawing Sheets

U.S. PATENT DOCUMENTS

| | | | | |
|---|---|---|---|---|
| 2009/0263772 | A1 | 10/2009 | Root et al. | |
| 2009/0291805 | A1 | 11/2009 | Blum et al. | |
| 2010/0246898 | A1 * | 9/2010 | Izumi | 382/106 |

FOREIGN PATENT DOCUMENTS

| | | | |
|---|---|---|---|
| EP | 0 974382 | A1 | 7/1999 |
| JP | 2004-065993 | | 3/2004 |

OTHER PUBLICATIONS

International Search Report and Written Opinion issued Apr. 5, 2010 by the Korean Intellectual Property Office for International Application No. PCT/US2009/004735.

http://en.wikipedia.org/wiki/wii_fitt, definition of Wii Fit, taken Mar. 5, 2012.

* cited by examiner

METHOD AND APPARATUS FOR INTEGRATING PHYSICAL EXERCISE AND INTERACTIVE MULTIMEDIA

This application is a Continuation-in-Part of U.S. patent application Ser. No. 12/541,908, which was filed on Aug. 14, 2009 now U.S. Pat.No. 8,025,606, which was a non-provisional application of U.S. Provisional Application Ser. No. 61/089,400, which was filed on Aug. 15, 2008.

BACKGROUND OF THE INVENTION

1. Field of the Invention

This invention relates to physical exercise and multimedia, and more particularly to a device for integrating physical exercise with interactive multimedia systems such as game consoles, networks, and/or the internet.

2. Background

Over the years, various systems and methodologies for promoting wellness, physical activity/education, and/or brain development have been created. See, e.g. U.S. Pat. No. 7,108,635 for a "Yoga Mat with Body Contact Placement Indicia"; U.S. Pat. No. 5,949,951 for an "Interactive Workstation for Creating Customized, Watch and Do Physical Exercise Programs"; and, U.S. Pat. No. 7,063,535 for a "System and Method for Facilitating Early Childhood Brain Development". Moreover, various setups have been developed for interactive multimedia systems useable for numerous applications. See, e.g., U.S. Pat. No. 7,158,676 for "Interactive Systems"; U.S. Pat. No. 5,464,946 for a "System and Apparatus for Interactive Multimedia Entertainment"; and, U.S. Pat. No. 7,401,100 for a "Method of and Apparatus for Synchronizing Interactive Content". However, one drawback of these prior systems and methods is they do not provide a means for integrating anthropometrically-based physical exercise programs and education with interactive multimedia. Moreover, they do not suitably address normal health issues as well as a myriad of health problems such as ADHD, diabetes, and obesity through means of fun instructional material and readily available physical exercise curricula and content.

Modern, sedentary lifestyles characterized by activities such as: watching television and movies, using the computer and internet, and playing games on the internet and/or on gaming systems lend themselves to many health concerns. As a result of modern lifestyles, the Surgeon General warns that this generation of children may be the first with a life expectancy lower than that of its parents. Moreover, as many as 1 in 3 children are predicted to develop diabetes by age 20. Therefore, it is desirable to provide systems and methodologies for improving wellness through physical exercise and education while also appealing to modern lifestyles.

The present invention seeks to provide systems for integrating anthropometrically-based physical exercise and interactive multimedia, with the systems being fun and educational, promoting health and wellness, and appealing to those with modern lifestyles. Moreover, the present invention seeks to provide a means for making health and exercise readily available and accessible through the use of education and entertainment platforms.

At least one embodiment of the present invention provides an exercise/yoga mat which is used interactively with multimedia and is accessible to school programs, curricula, education, and the home. The exercise/yoga mat can be used alone or in conjunction with multimedia such as video displays and/or video games. Furthermore, the mat is a multifunctional design that supports proper positioning for multiple forms of physical exercise and training techniques for kids, adults, families, and teachers, facilitating such games and activities as yoga, martial arts forms and stances, dance, sports training, body sculpting, creative movement, and so forth. Various other possible embodiments comprise electronic interactive exercise/yoga mats with digital components, video displays, and/or video games, thus providing a user friendly apparatus compatible with the digital and entertainment environment.

SUMMARY OF THE INVENTION

The present invention provides exercise systems and methods with integrated multimedia devices that appeal to modern lifestyles while physically engaging participants. In at least one embodiment according to the present invention, an interactive physical exercise device is provided, said device comprising a mat with a top surface and a bottom surface, and a plurality of graphics disposed on the top surface of the mat, with the graphics specifically arranged to assist with proper body placement and alignment. An interactive system is also provided for instructing on proper use of said graphics.

In another embodiment according to the present invention, an interactive physical exercise system is provided comprising a mat with a top surface and a bottom surface, and a plurality of indicia disposed on the top surface of the mat, with the indicia specifically arranged to assist with proper body placement and alignment. Electronic equipment is disposed within the mat for detecting movement on and weight applied to the indicia and the top surface of the mat. An apparatus for interacting with the electronic equipment and providing feedback for proper use of the mat is also provided.

In another embodiment according to the present invention, a method is provided for an interactive physical exercise system comprising providing a mat with a top surface and a bottom surface and providing a plurality of graphics disposed on the top surface of the mat and specifically arranged to correspond with anthropometric points on a user's body. Furthermore, the graphics are used to assist with proper body placement and alignment. Instruction is provided for proper use of the graphics using integrated multimedia.

These and other further features and advantages of the invention will be apparent to those skilled in the art from the following detailed description, taken together with the accompanying drawings, in which:

DETAILED DESCRIPTION OF THE INVENTION

Figure 1A:
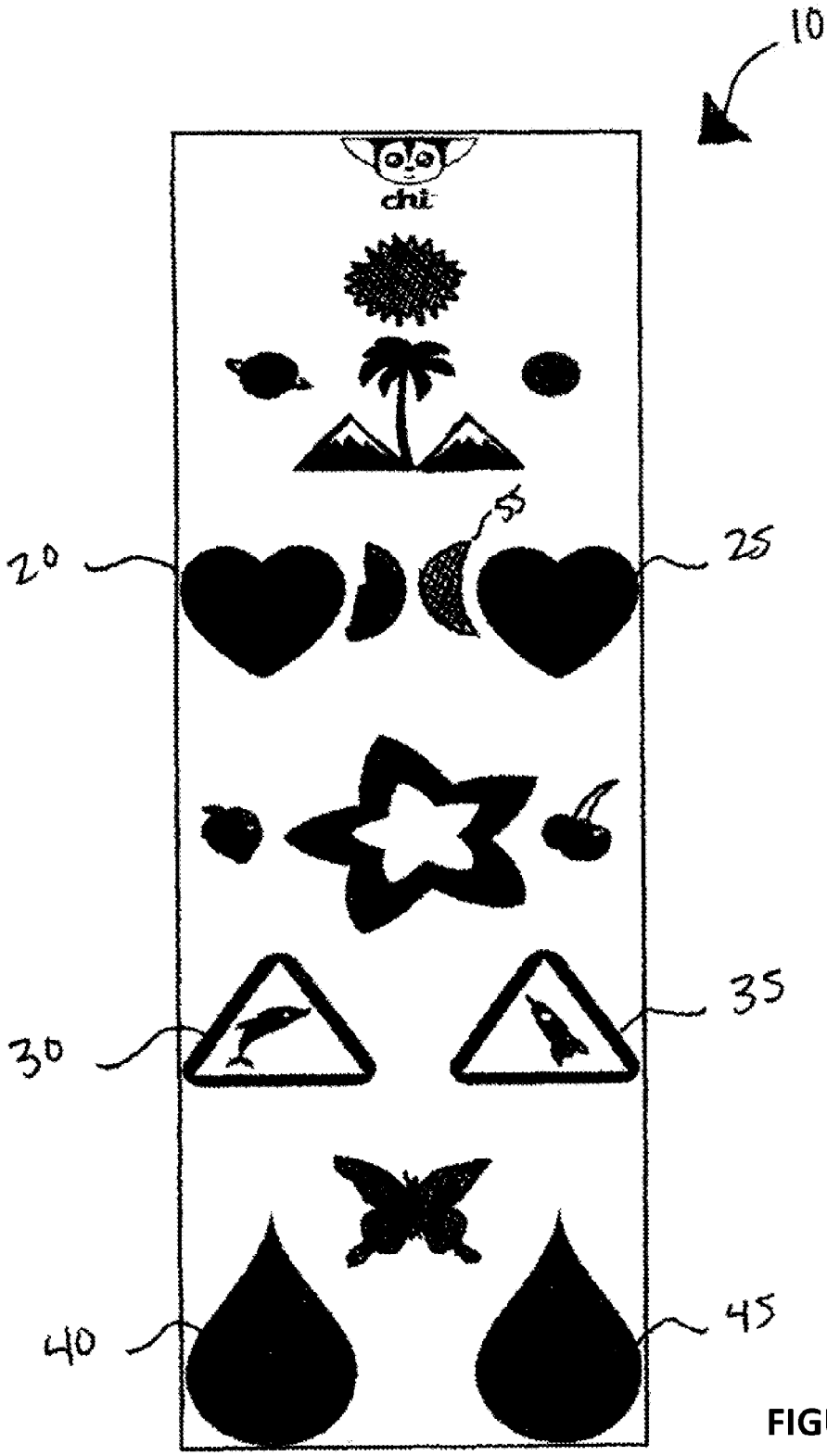
FIG. 1A is an overhead perspective view of one embodiment of a mat according to the present invention.

The following description presents several possible embodiments. This description is not to be taken in a limiting sense but is made merely for the purpose of describing the general principles of the invention, the scope of which is further understood by the appended claims.

Embodiments of the invention are described herein with reference to illustrations that are schematic illustrations of idealized embodiments of the invention. As such, variations from the shapes and configuration of the illustrations are expected. Embodiments of the invention should not be construed as limited to the particular shapes illustrated herein but are to include deviations in shapes and combinations of shapes that result, for example, from different desired designs. A feature illustrated or described as square or rectangular can have rounded or curved features in various embodiments. Thus, the features illustrated in the figures are not intended to illustrate the precise shape of a feature or configuration of various shapes and are not intended to limit the scope of the invention.

The present invention provides apparatuses and methods for integrating physical exercise/education with interactive multimedia systems. Some embodiments are particularly applicable to use in live classes, video interactions, game play, and internet participation. Embodiments of the present invention are generally directed to exercise/yoga mats which can be used alone or in conjunction with multimedia such as video displays and/or video games. The mats generally provide multi-functional designs that support proper positioning for multiple forms of physical exercise and training techniques for numerous users, facilitating such games and activities as yoga, martial arts forms and stances, dance, sports training, body sculpting, creative movement, physical therapy, etc. The design symmetry of the mats corresponds to body symmetry, biological measurements, and postures. Other possible embodiments comprise electronic interactive exercise/yoga mats with digital components, video displays, and/or video games.

Integrated systems according to the present invention are intended to make health and exercise fun, readily available, and readily accessible via education and entertainment platforms. The systems are also intended to assist users by providing guidance for proper body alignment and varying combinations and sequences of movement. In this way, the systems can integrate exercise into various institutions where instructors and/or other users may not have the proper education or skill level to safely teach and/or perform physical exercise such as yoga and creative movement. Furthermore, the systems are intended to make fitness games/activities more focused and safe using alignment features that are cleverly embedded through the anthropometric, graphical layout.

At least one advantage of the present invention is the ability to support children's health, education, teacher/student relationships, family relationships, social networks and interactive play for education, entertainment, sports training, physical rehabilitation, and special needs. The apparatuses and methods of the present invention also offer teachers/instructors a tool to work with curricula and develop personal and multi-user trainings, as well as providing programs and learning tools for children and adults.

Furthermore, the interactive physical exercise and therapeutic movement methodology is useful in combining health, education and entertainment and has been developed for general wellness. Particular focus may also be placed on children's health, obesity and diabetes prevention, possible obesity and Type 2 Diabetes reversal, focused active learning for students with A.D.D. and A.D.H.D., anti-anxiety and anti-depression, possible reversal of asthma, neuro-physiological development, neurological reprogramming, rehabilitation and range of motion. Additionally, mat and yoga methods aid in proper organ system function, circulatory health, respiratory health, digestion, and endocrine and adrenal function to help regulate hormonal balance and detoxification processes. Yoga is also known to have calming and relaxing effects on the central nervous system. Moreover, because apparatuses and methods according to the present invention also focus on multi-functional designs accounting for anthropometrics, they are also applicable for numerous physical fitness programs and therapies facilitating high level technique and sports training for competitive athletics and non-competitive fitness and activities.

According to one embodiment of the present invention, an apparatus such as a mat or cushioned pad includes an array of graphics arranged for proper body placement and body alignment for yoga and multiple other forms of physical exercise. The arrangement of the graphics maps and guides placement for hands, elbows, knees, feet, sacrum, seat bones, belly, head, and any combination thereof for creative postures, movements, and sequences. The graphics also enable body placement in more effective positions to facilitate and support rehabilitation, balance, growth, posture, and proper anatomical alignment based on bones, muscles, and bone and spine lengths for age-appropriate anthropometric anatomy averages. The use of the apparatus also assists practitioners and instructors in: combining flowing sequences and combinations; and interactive play of physical exercise, methods, and games.

In a further aspect of the present invention, the apparatus may be used in conjunction with games, educational tools, and/or other interactive multimedia to guide users through sequences of postures and/or creative movements. The interactive multimedia combines the elements of physical exercise, methods, and games for interactive play. An array of technologies such as video displays, video games, the internet, and so forth may be used to deliver interactive multimedia. The combination of the mat and/or cushion apparatus with use of multimedia is designed to provide a fun interactive experience for teaching proper alignment for education and safety while focusing on health and wellness. Instructional material may be delivered through teaching, text, workbook, print, lyrics, music, video, multimedia, games, video games, graphics, animation, and/or web, so as to provide sequenced exercises and a protocol for interactive education and multimedia entertainment.

The games that may be associated with the apparatus and symbols on the mat and/or cushion incorporate a combination of print, video, and/or graphical output to synchronize use with the apparatus design. Further, the games may incorporate sound and music with symbols, body placement, and length of posture/positions and sequences synchronized with sound/music, and songs.

In a further aspect of the invention, an electronic and/or high-tech version of the mat and/or cushion may be provided. The electronic/high-tech mats and/or cushions may be used with gaming consoles, massively multiplayer online games (MMO), interactive classes, the internet, cell phone technologies, social networks, and so forth as a fitness based music and entertainment. This version of the mat may be based on anthropometric body measurements and proper positioning on timed systems and with biofeedback loops. The electronic/high-tech mats and/or cushions may comprise weight sensors, which can aid in facilitating balance and proper alignment. For example, with the yoga position "Down Dog", otherwise known as "Adho Muhka Svanasana", the pose is on hands and feet where the coccyx is moving up and back toward the ceiling while heels descend toward the floor. The weight sensitive measures can instruct and provide feedback for the user and/or practitioner on where the weight is distributed and which direction they should redistribute weight. In the Down Dog pose example, more weight should be distributed in the feet and legs and less in the arms, thus relieving weight burdens on and preventing overstretching in the shoulders.

The electronic/high-tech mats may be coupled with one or more of warning devices, LED lights, memory devices, associated speakers, speech synthesizers, audio/video feed/biofeed, realignment sensors or voice guidance to correct postures based on body measurements including height and weight, weight distribution, heart rate, length and timing of posture held, and timing of breath. Additionally, provisions can be made for reading of directional movement including spiral movements of energy lines (meridians) through the body (nadis); lifting and alignment of bones and skeletal structure, musculature, the pelvis, shoulders, spine, vertebrae, vertebral column, and biofeedback and instruction can be provided based thereon. The systems may further provide measurement of vital signs and brain frequency to give biofeedback on meditative state, including responsive light and/or audio guidance and/or voice guidance for breath control, programs for breath control techniques to change brain/meditative frequencies, and deep relaxation and de-stress techniques, programs and control systems.

The timing and biofeedback systems may, for example, instruct the practitioner and/or user on how long to hold a pose while also correlating the length held with the rhythm and timing of the breath. Breathing is a fundamental and important guideline to physical movement, bodily awareness, and mind-body control. Biofeedback systems may also provide feedback on biorhythms and functions of the body such as heart rate. The biofeedback systems may also assist with mental focus while training. Machine generation of original flow sequencing and programming can also be based upon the user's level of physical capability, performance, and increases/improvements in skill, flexibility, agility, strength, overall health, and brain function.

The electronic/high-tech version of the apparatuses may also be linked to systems such that movement or weight placement on various positions of the mat and/or cushion result in audio or visual response. In this way, the apparatus' combination of symbols and touch-sensitive, timed-response feedback loop with auditory and graphic instruction create an experience where the user creates a fitness-based interactive music and entertainment experience. For example, via movement and weight placement, a user can essentially become an instrument and/or music artist.

The following descriptions for possible embodiments of the present invention are provided as examples to help illustrate several appropriate uses for the present invention. The descriptions are not intended to limit the present invention to the examples provided. It is understood that many other variations of apparatuses and methods are appropriate under the scope of the present invention.

Chi Interactive Mat & Game

Referring to FIGS. 1A-4, the "Chi Interactive Mat, Chi Flow and Phreeze Game" provides one example of a game using an embodiment of an interactive mat and/or cushion according to the present invention. The mats and/or cushions, and the games that utilize the mats, are designed for participants to interface with the design and to safely instruct and lead participants through several series of various exercises and yoga sequences with focus on breathing and alignment. Use of this interactive mat/cushion and game may result in increased health, well-being, and mental focus for optimal learning.

The specially designed mats/cushions utilize symbols that are easy to recognize and are positioned on the mat for proper body placement. While the curriculum for the use of the mat is presented as an interactive game, it may also be referred to as a physical education program that promotes neuro-muscular development, motor coordination, agility, strength training, weight loss, and flexibility. The design allows various skill levels and variations in positions so teachers can easily implement exercise programs for different user's abilities.

This embodiment may further include teacher training programs, online tutorials and teacher training conferences to help educators successfully apply curriculum and mat packages to their classrooms.

By way of example and not limitation, dimensions for mats/cushions may be as follows:

Elementary: 24"×60-68"×3-4 mm for use by children ages 5-10 and adults under 5 foot in height Long: 24"×68"×3-4 mm for use by teachers/adults/students 11 & up and over 5 foot in height)

The variation among the mats is such that the size and spatial relationship of the symbols and layout is according to biological measurement averages of the mat. Ages are approximate. A smaller toddler size and a combination mat/cushion may also be provided for toddler interaction such as in "Mommy and Me" programs (see below). Appropriate dimensions for such a combination toddler mat may be: 24"×60"×3-4 mm. The mats/cushions may be rolled up so they can be easily stored.

To accommodate various heights of students, the symbol spacing and size of the symbols provide for larger mat coverage and create enough space to compensate for different sizes. While a user is encouraged to touch the symbols associated with a movement or pose, it is sufficient if the proper body part is near the symbol (or within range for sensory detection of placement in high-tech versions). For example, if fingers or toes are within an inch or two of the symbol and such placement is coupled with mirroring the proper posture shown in the curriculum, the child will still be guided into a more technically correct position. It is better for the exercise to feel right than for the placement to be on the center of the symbol. The objective is for users to perform postures and movements with more accuracy, not perfection. The mat makes for easier learning and alignment and provides a way to properly develop skill levels.

A typical instructional lesson plan for this embodiment may provide a mat and lesson plans, instructions, and video instruction. Additionally, video and video games can be downloaded using the internet.

Teacher Training

Teacher training helps educators integrate the yoga and exercise curriculum into their classrooms, gyms, studios, homes, offices, and networks. The programs are designed with various lengths to meet teachers' and users' unique needs. The curricula are meant to be a tool, and the sequences are interchangeable. The programs can easily be allotted any length of time. For example, a daily 10-minute or 20-minute cardio and stretch practice can be set up, or shorter 5-minute increments of exercise can be used on busy days to help focus a users' energy. Alternatively, programs can be expanded to 30-minute sequences.

The mats/cushions are specifically designed as interactive tools to encourage safety, alignment, and creativity to movement. Teachers can utilize the mats to learn, design, and record programs. Teachers are not required to be on the mat while students perform exercises.

"Parent and Child"

Another example of an embodiment of the present invention comprises a matching "Interactive Mat Set" designed to facilitate two-person interaction, such as "Mommy and Me"™ type programs for parent and child yoga or teacher/student learning. In this example, matching symbols are arranged and applied to the same or different size mats, to inspire a play-a-long relationship, encouraging the child and/or user to observe and learn while moving in sequence alongside the parent and/or instructor. This can help to foster healthy parent/child or student/teacher interaction. The different sized mats may be placed adjacent to each other. Alternatively, a single mat may be provided that includes two or more adjacent sets of symbols arranged as set forth in the single mat.

At least one purpose of the symbols is to create a method/game that teaches exercise, yoga, and/or movement through functional design with an emphasis on technique. The symbols are strategically arranged to suit different body lengths. For example, the mats can be provided in three different lengths to cover height variations for toddlers, elementary school children, and older children to adults (i.e., over 5 feet).

An electronic version of a mat/cushion may also be used. The individual is measured from the heels through sacrum, shoulders, and to the tip of the head; sensors are placed in or on the mat at the various symbols to coordinate with the particular student's structure and size.

By way of example and not limitation, the following table (in conjunction with the mat illustrated in FIG. 1A) provides a list of symbols, sizes, and locations to orient for location poses and body movements for kids ages approximately 5-9 (less than about 5 foot tall):

| Art Object | Art Width | Art Height | center to left edge | center to top edge |
|---|---|---|---|---|
| chi head | 4.384" | 2" | 12" | 2.3" |
| chi logo | 1.77" | .854" | 12" | 3.86" |
| sun | 3.905" | 3.905" | 12" | 7.168" |
| Saturn | 2.888" | 1.744" | 7.581" | 11.088" |
| earth | 1.893" | 1.893" | 16.487" | 11.085" |
| mountains | 7.292" | 2.2" | 12" | 13.89" |
| palm tree | 3.109" | 5.435" | 12" | 12.29" |
| left heart | 5.185" | 5.327" | 7.374" | 20.635" |
| watermelon | 1.823" | 3.738" | 10.931" | 19.826" |
| moon | 1.973" | 3.764" | 13.103" | 19.835" |
| right heart | 5.185" | 5.327" | 16.658" | 20.635" |
| strawberry | 1.852" | 2.391" | 6.429" | 29.779" |
| star | 8.04" | 8.206" | 12" | 29.824" |
| cherries | 2.414" | 3.245" | 17.305" | 29.371" |
| dolphin | 6.053" | 5.429" | 7.802" | 37.3" |
| rocket | 6.053" | 5.429" | 16.144" | 37.3" |
| butterfly | 4.9" | 4.235" | 12" | 45.143" |
| raindrop left | 4.581" | 8.585" | 7.704" | 50.677" |
| raindrop right | 4.581" | 8.585" | 16.323" | 50.677" |
| Phresh logo | 6.338" | 1.626" | 11.661" | 56.347" |

Other embodiments are designed for different body size measurements; the mats can include various symbols, various dimensions of symbols and the mats may be of various dimensions appropriate for different size/age users.

Figure 2:
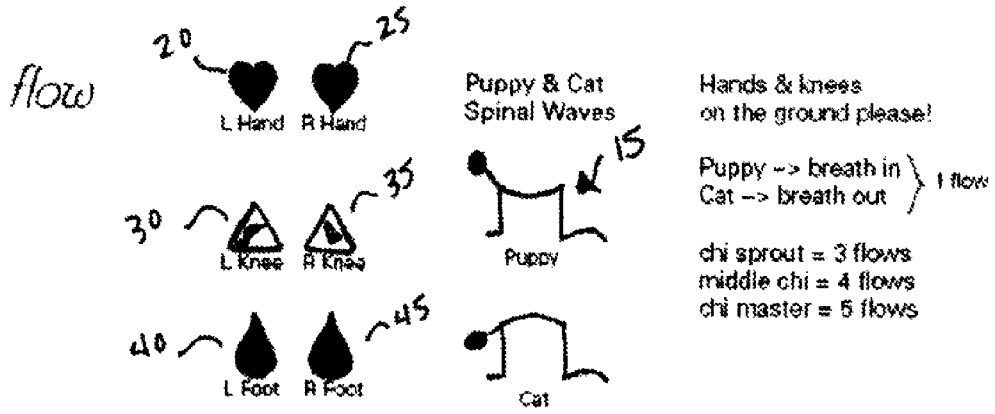
FIG. 2 is a schematic view of one example of common yoga poses and games using these poses according to the mat embodiment of FIG. 1A.
Figure 3:
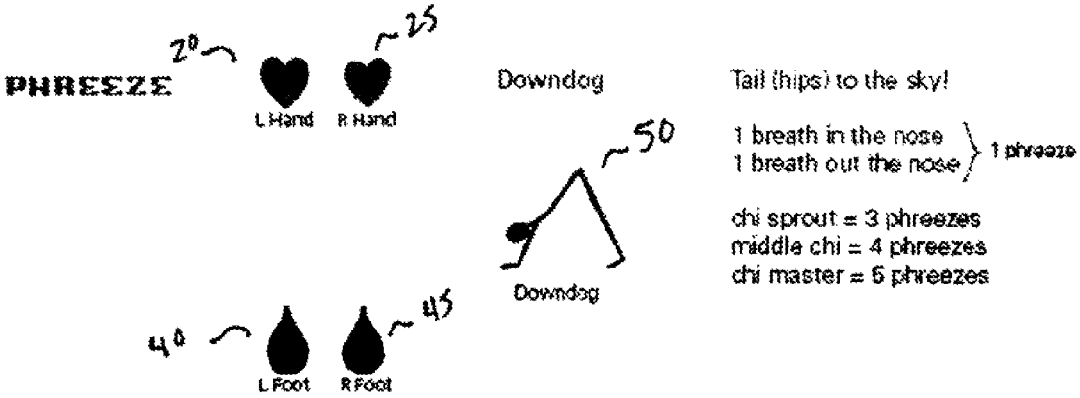
FIG. 3 is a schematic view of another example of common yoga poses and games using these poses according to the mat embodiment of FIG. 1A.
Figure 4:
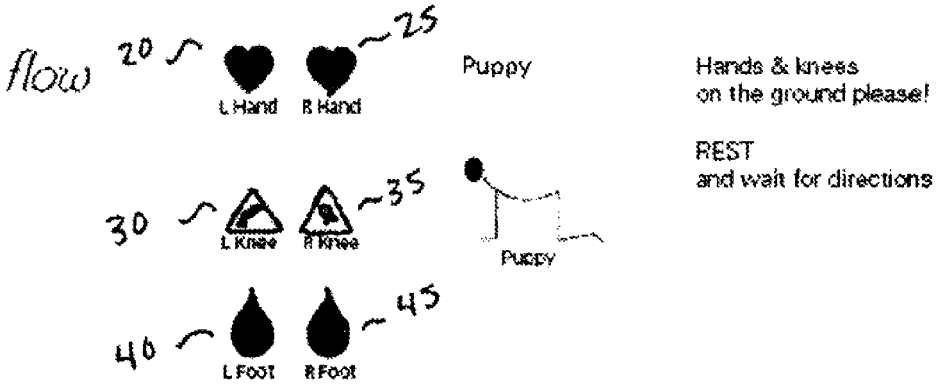
FIG. 4 is a schematic view of another example of common yoga poses and games using these poses according to the mat embodiment of FIG. 1A.

Referring to FIG. 1A, the following is an example of how the symbols may be used in practice. The names of the poses or positions discussed below and illustrated in FIGS. 2-4 are common terms understood by those skilled in the art of yoga. However, it is understood that the symbols, configuration, poses, terms, dimensions, and so forth may be changed and customized while still remaining in the scope of the present invention. FIG. 1A illustrates one example of a mat 10 according to the present invention, on which a participant can begin with a pose. For example, the participant may begin with the puppy pose 15, with his/her left hand on the mat's left heart 20, the right hand on the mat's right heart 25, left knee on the mat's left triangle 30, right knee on the mat's right triangle 35, left foot on the mat's left raindrop 40, and right foot on the mat's right raindrop 45 (See also, FIG. 2).

Figure 1B:
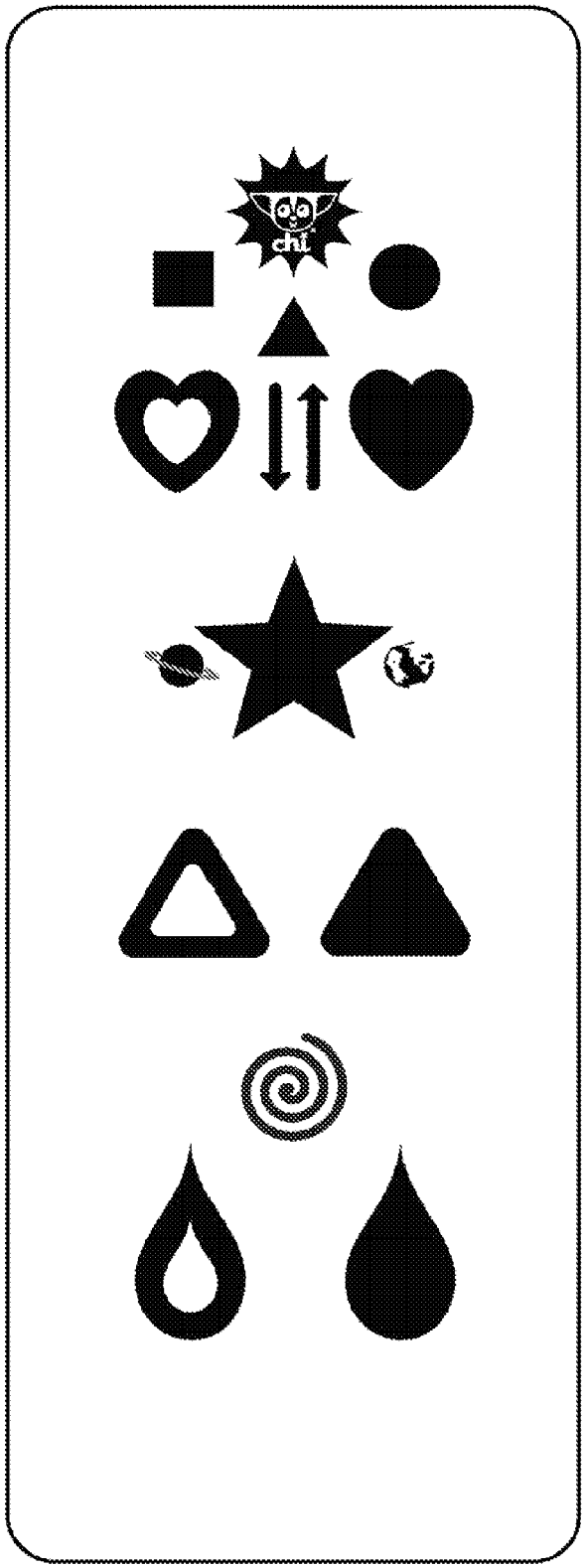
FIG. 1B is an overhead perspective view of another embodiment of a mat according to the present invention.

It should be noted that the symbols depicted in FIG. 1A can be altered to accommodate different positions and users of different sizes. For example, FIG. 1B illustrates another example of a mat with different symbols at different positions. It should be understood that the mat can be made in different sizes to accommodate users of different ages, non-limiting examples of which include (1) a "Tween/Teen Adult Mat" that fits users that are five feet tall and taller (most kids ages 10 and up), (2) a "Mama/Me Mat" that fits users of approximately five feet tall, (3) a "Li'l Chi/Toddler Mat" that fits kids of approximately 3-6 years old, and (4) a "Kid's Mat" that first kids that approximately five feet tall and smaller, which fits most kids that are 6-10 years old. Provided below are non-limiting examples of suitable locations for the symbols depicted in the mat as illustrated in FIG. 1B.

| Tween/Adult Mat Design/Symbol Locations and Mama/Me Mat Design/Symbol Locations | |
|---|---|
| Chi | Top point anchor x: 11.95", y: 68.87"; anchor point bottom x: 11.95", y: 63.14" |
| Top Square | Center x: 5.97", y: 63.4"; left top x: 4.46", y: 64.91"; right top x: 7.48", y: 64.91"; left bottom x: 4.46", y: 61.89"; right bottom x: 7.48", y: 61.89" |
| Top Circle | Center x: 17.96", y: 63.53"; right side radius point x: 19.68", y: 63.53" |
| Triangle | Top anchor x: 11.97", y: 61.34", left bottom x: 9.97", y: 55.67", right bottom x: 13.96", y: 57.89" |
| Left open Heart | Top middle anchor x: 5.92", y: 56.99"; upper inner x: 5.82", y: 50.34"; bottom inner x: 5.86", y: 51.86"; bottom x: 5.86", y: 50" |
| Right solid Heart- | Top anchor middle x: 18.11", y: 56.94"; bottom anchor x: 18.1", y: 50" |
| Left back facing Arrow | Top anchor: x: 11.06", y: 56.26; bottom anchor x: 11.05", y: 49.97" |
| Right forward facing Arrow | Top anchor x: 12.96", y: 56.26"; bottom anchor x: 12.95", y: 49.97" |
| Star | Top point anchor x: 11.96", y: 44.49"; bottom middle anchor x: 11.95", y: 37.6"; bottom left point x: 9.1", y: 35.76"; bottom right point x: 14.78", y: 35.75" |
| Left Planet/Saturn | Center anchor x: 6.19", y: 38.72"; ring left anchor x: 4.51", y: 39.45"; ring right anchor x: 7.97", y: 38.25" |
| Right Planet/Earth- | Left anchor x: 16.69", y: 39"; right anchor x: 18.83", y: 39.05" |
| Left Triangle | Top anchor x: 6.11", y: 34.91"; left bottom anchor x: 1.83", y: 28.01"; right bottom anchor x: 10.55", y: 28.02" |

-continued

| Tween/Adult Mat Design/Symbol Locations and Mama/Me Mat Design/Symbol Locations | |
|---|---|
| Right Triangle | Top anchor x: 17.78", y: 34.91"; bottom left anchor x: 13.42", y: 28.09"; bottom right anchor x: 22.13", y: 28.1" |
| Spiral | Center anchor x: 11.78", y: 19.09"; top anchor x: 12.52", y: 21.53" |
| Open Raindrop | Top point anchor x: 5.99", y: 18.25"; bottom anchor x: 5.92", y: 5.34"; inner top anchor x: 5.97", y: 13.42"; bottom inner anchor x: 5.93", y: 7.17"; left side wide anchor x: 2.48" |
| Solid Raindrop | Top point anchor x: 18.07", y: 18.29"; bottom anchor x: 18.05", y: 5.34"; widest right anchor x: 21.47" |

| Kid's Mat Design/Symbol Locations | |
|---|---|
| Chi | Top point anchor x: 11.97", y: 62.64"; anchor point bottom x: 11.97", y: 56.91" |
| Top Square | Center x: 7.36", y: 55.91"; left top x: 6.13", y: 57.14"; right top x: 8.58", y: 57.14"; left bottom x: 8.58", y: 54.69"; right bottom x: 6.13", y: 54.69" |
| Top Circle | Center x: 16.63", y: 56.01"; right side radius point x: 18.09", y: 56.01" |
| Triangle | Top anchor x: 11.98", y: 55.14", left bottom x: 10.47", y: 52.53", right bottom x: 13.48", y: 52.53" |
| Left open Heart | Top middle anchor x: 7.09", y: 51.2"; upper inner x: 7.05", y: 50.34"; bottom inner x 7.08", y: 47.79"; bottom x: 7.08", y: 46.54" |
| Right solid Heart- | Top anchor middle x: 16.89", y: 51.26"; bottom anchor x: 16.91", y: 46.62" |
| Left back facing Arrow | Top anchor: x: 11.21", y: 51.35"; bottom anchor x: 11.22", y: 46.64" |
| Right forward facing Arrow | Top anchor x: 12.81", y: 51.35"; bottom anchor x: 12.81", y: 46.64" |
| Star | Top point anchor x; 12", y: 43.75"; bottom middle anchor x; 11.99", y: 37.48"; bottom left point x: 9.4", y: 35.8"; bottom right point x: 14.57", y: 35.79" |
| Left Planet/Saturn | Center anchor x: 7.25", y: 38.88"; ring left anchor x: 5.73", y: 39.54"; ring right anchor x: 8.85", y: 38.46" |
| Right Planet/Earth | Left anchor x: 15.83", y: 38.8"; right anchor x: 17.82", y: 39.28" |
| Left open Triangle | Top anchor x: 7.86", y: 33.34"; left bottom anchor x: 4.66", y: 28.36"; right bottom anchor x: 10.95", y: 28.37" |
| Right solid Triangle- | Top anchor x: 16.26", y: 33.37"; bottom left anchor x: 13.14", y: 28.49"; bottom right anchor x: 19.38", y: 28.49" |
| Spiral | Center anchor x: 11.8", y: 20.78"; top anchor x: 12.49", y; 23.08" |
| Open Raindrop | Top point anchor x: 7.68", y: 19.71"; bottom anchor x: 7.63", y: 11.09"; inner top anchor x: 7.67", y: 16.49"; bottom inner anchor x: 7.64", y: 12.3"; left side wide anchor x: 5.34" |
| Solid Raindrop | Top point anchor x: 16.49", y: 19.61"; bottom anchor x: 16.47", y: 11.03"; widest right anchor x: 18.74" |

| Li'l Chi/Toddler Mat Design/Symbol Locations | |
|---|---|
| Chi | Top point anchor x: 11.87", y: 58.05"; anchor point bottom x: 11.87", y: 54.19" |
| Top Square | Center x: 7.84", y: 54.37"; left top x: 6.82", y: 55.39"; right top x: 8.86", y: 55.39"; left bottom x: 6.82", y: 53.35"; right bottom x: 8.86", y: 53.35" |
| Top Circle | Center x: 15.92", y: 54.46"; right side radius point x: 17.08", y: 54.46" |

-continued

| Li'l Chi/Toddler Mat Design/Symbol Locations | |
|---|---|
| Triangle | Top anchor x: 11.88", y: 53.05", left bottom x: 10.72", y: 51.04", right bottom x: 13.04", y: 51.04" |
| Left open Heart | Top middle anchor x: 7.56", y: 50.43"; upper inner x: 7.55", y: 49.53"; bottom inner x: 7.55", y: 46.98"; bottom x: 7.54", y: 45.72" |
| Right solid Heart | Top anchor middle x: 16.26", y: 50.04"; bottom anther x: 16.26", y: 45.72" |
| Left back facing Arrow | Top anchor: x: 11.17", y: 49.94; bottom anchor x: 11.18", y: 45.7" |
| Right forward facing Arrow | Top anchor x: 12.68", y: 49.94"; bottom anchor x: 12.67", y: 45.7" |
| Star | Top point anchor x: 11.9", y: 42.87"; bottom middle anchor x: 11.89", y: 37.95"; bottom left point x: 9.86", 36.64", bottom right point x: 13.91", y: 36.63" |
| Left Plane/Saturn | Center anchor x: 7.81", y: 39.59"; ring left anchor x: 6.57", y: 39.28"; ring right anchor x: 9.05", y: 38.42" |
| Right Planet/Earth | Left anchor x: 15.22", y: 38.68"; right anchor x: 16.81", y: 39.99" |
| Left Triangle | Top anchor x: 7.97", y: 35.57"; left bottom anchor x: 5.03", y: 30.97"; right bottom anchor x: 10.91", y: 30.98" |
| Right Triangle | Top anchor x: 15.78", y: 35.55"; bottom left anchor x: 12.84", y: 30.95"; bottom right anchor x: 18.72", y: 30.95" |
| Spiral | Center anchor x: 11.71", y: 24.76"; top anchor x: 12.19", y: 26.26" |
| Open Raindrop | Top point anchor x: 7.85", y: 24.34"; bottom anchor x: 7.84", y: 15.61"; inner top anchor x: 7.84", y: 21.09"; bottom inner anchor x: 7.84", y: 16.85"; left side wide anchor x: 5.49" |
| Solid Raindrop | Top point anchor x: 15.99", y: 24.34"; bottom anchor x: 15.98", y: 15.61"; widest right anchor x: 18.29" |

Referring again to FIG. 1A, the "flow" is the movement or transition from one movement or pose to the next, and based on breath with movement. For example, in moving from the puppy pose 15 into the Down dog pose 50, the participant moves his/her knees off the mat triangles 30, 35 and lifts his/her hips into the air, such as shown in FIG. 3. The participant would then hold the pose, or "phreeze", for various numbers of breathes according to skill level. The next instructions would lead the flow from Down dog into the next pose, for example, the three-legged Down dog (not shown) where the instruction from either a teacher or other multimedia source would lead the participant to place the left hand on the mat's left heart 20, right hand on the mat's right heart 25, left foot on the mat's left raindrop 40, and right foot in the air. This could be a transition "flow" or "phreeze" depending on sequence and instruction.

A next instruction could be a right lunge (not shown) which comprises raising the right foot into the air to the mat crescent moon symbol 55. Proper instruction would also be advised, for example, to make sure that the right knee is perfectly centered over the ankle to assure a safe pose. The presence of the symbols on the mat creates a safer lunge position for the participant. The game can continue with lengths of "phreezes" according to the experience level of the participant. For example, five breathes in lunge pose equals approximately a 30-second hold for adult lung capacity; a breath comprises 1 inhalation and 1 exhalation. The mat interaction game also teaches balance. For example, the instruction can lead the participant to bring one or both hands off the floor, and the symbols may be described as left foot on the mat's rain drop 40, right foot on the mat's crescent moon 55, and both hands straight up to the sky.

While the symbols on the mats are selected for their appeal to the participants and ease of identification, the mats can be customized with various symbols, colors of symbols, characters and sounds which can be matched with video displays, games, recordings, or free flowing (free-styling) with music. Participants and instructors can customize the programs, sequences, games, curriculum, and therapies as they desire.

The programs used along with the mat are advantageous for teaching scenarios because the mat with symbols gives the teachers reference points to assist the participants into establishing correct positioning through a hands-on relationship with the participants.

The sequencing of a series of steps can be created and re-created by teachers, students and any participant and recorded and shared. This aspect is limitless and fosters creativity. The goal is to engage the participant and encourage them to reach a level where they can create their own poses, sequences, mapping, flowing, "phreezing", and programming.

As an alternative to a live instructor, a personal trainer as animation or through audio recordings, videos, internet games, and so forth can be used to take the participants through the steps of the mat, and are beneficial to teach movements and sequences, as well as reminders for focusing on technique, create and achieve goals, and to instruct on proper alignment and technique as well as track students/practitioners progress and development of alignment, flexibility, strength, and posture. A video presentation demonstrating the use of the mat can make it easy to see symbols and proper body alignment of the instructor in the video. A corresponding video display and video game input can be live action, a combination of live action and animation, or animation alone, and can be presented in 2D and/or 3D, as well as in any variation of a virtual world or projection. Multiple training programs can be provided through print, a graphic overlay and/or interactive mode to accommodate varying skills levels, and to build skill levels, coordination, neuro-muscular developments, motor skill and dynamic control.

The observer can be the live instructor/teacher, or the electronic interaction between the instructor and participants can be live or through recordings. Participant can also use electronic interactivity for self evaluation, or multiple users can co-participate, compete, participate in dance battles and circles, or/and be simultaneously observed and instructed over networks. The mats and or virtual gaming programs can encompass a recording feature to share live, or through recordings, the symbol position locations, poses, sequences, classes, and creative programs.

As described above, a possible further embodiment of an apparatus according to the present invention comprises an electronic mat/cushion using an interactive gaming device. This provides added benefit for self-teaching and testing, personal training and coaching, as well as playing or interacting with others through networks and other programs such as live fitness classes, therapeutic programs and e-learning workshops. The interface can be used by single players or multiple players and can be delivered through multimedia video systems encompassing an array of technologies including broadcast, computers, consoles, internet, networking, and e-commerce. Storage devices for sharing music, video, and individually designed programs can be provided for networking based on mat functionalities.

Yet another possible embodiment of an apparatus according to the present invention is a multiple person mat. This multi-user mat may comprise: two separate mats, each of which has a set of identical symbols; one mat with two sets of symbols; or, one mat with more than two sets of symbols. Alternatively, multiple remotely located sets of mats can be used through networking.

In another aspect, the mat can be connected with an expansive array of technologies:

For example, the mat and/or mat symbols can be used to create online games, console games, 3D games, social network games for physical interactive game play and/or for edutainment and educational purposes.

The device function interacts with the digital space and provides a reference for performing one or more postures, moves or sequences of postures and moves through digital applications such as apps, downloadable games and content, interactive online games, multiple social/online games, social space, social platforms, and wireless devices either installed in the mat or through separate technologies such as cellular devices, internet devices, and other technological networks. The mat may contain or work directly with cell phone and/or wireless technology using the appropriate hardware and/or software.

Text and Voice technology activation with the device can be used for instruction and correction of postures but also to create workouts, games, and programs, teacher-student programs, kids teaching kids, trainer-trainee, teams training live, and/or recorded programs. Voice technology through a live or digital instructor can correct body alignment, increase training efficiency and teaching instruction, play-along, or create live or recorded audio and/or video and/or game program content and/or instruction.

The mat games and instructions expand into multimedia applications, social media, and social interactivity, and, through and crossing over digital space, internet, social networks, live chat through consoles, cellular networks, networks, interactive technologies and technologies unknown.

The mat is a game space for kids and adults to play while simultaneously live chatting and instant messaging, interacting through social networks through voice to text, text to voice, video to video in addition to game play and/or instruction with friends, competitors, classes, and dance circles.

It should also be understood that the mat can be formed to operate with and as a game console. With a motion sensing system, such as a depth camera system, the mat is a device that functions in a number of ways. Provides a map or foundation for proper alignment for postures, stances, and sequences of moves, while receiving/providing additional instruction and/or feedback regarding body positioning, breathing technique, alignment, balancing, and stabilizing, reading dispersion of weight, and vital signs. The mat and motion sensing system can create programs that can be shared live or recorded. For example, the mat and motion sensing system can be formed to work with the Kinect camera (or similar devices) so that physical bodies can be converted to in-game controls or video capture to propel live and recorded education system and gaming. However, in addition, the mat provides a foundation, increasing technical physical alignment and a way to teach and align the body correctly providing a spatial, or non-spatial representation of the images, and a way from which to build postures, sequences, game play, and instruction.

In this aspect, the participant's physical body becomes the game controller and can be recorded as a game character or teacher of the mat. These figures or comparative figures can demonstrate movements on the mat with the most anatomically correct musculo-skeletal and energetically aligned positions and movements in comparison to that of a game character or human participant model, where they can manipulate game characters, their own live images, in a multiplayer game setting, single player, or private training.

The device symbol locations and anatomical movements and postures create a way to develop social media and social interaction such as social networking, or game play with circles of friends and/or competitors on the mats live or against the game, or by simply using the symbol representations and combinations for instruction.

The locations of the symbols make it easier to build a solid anatomically correct foundation for postures and movements and simplifies correcting additional appendages or postures, and align other aspects of the body making it easier to respond to virtual game controller feedback.

Figure 5:
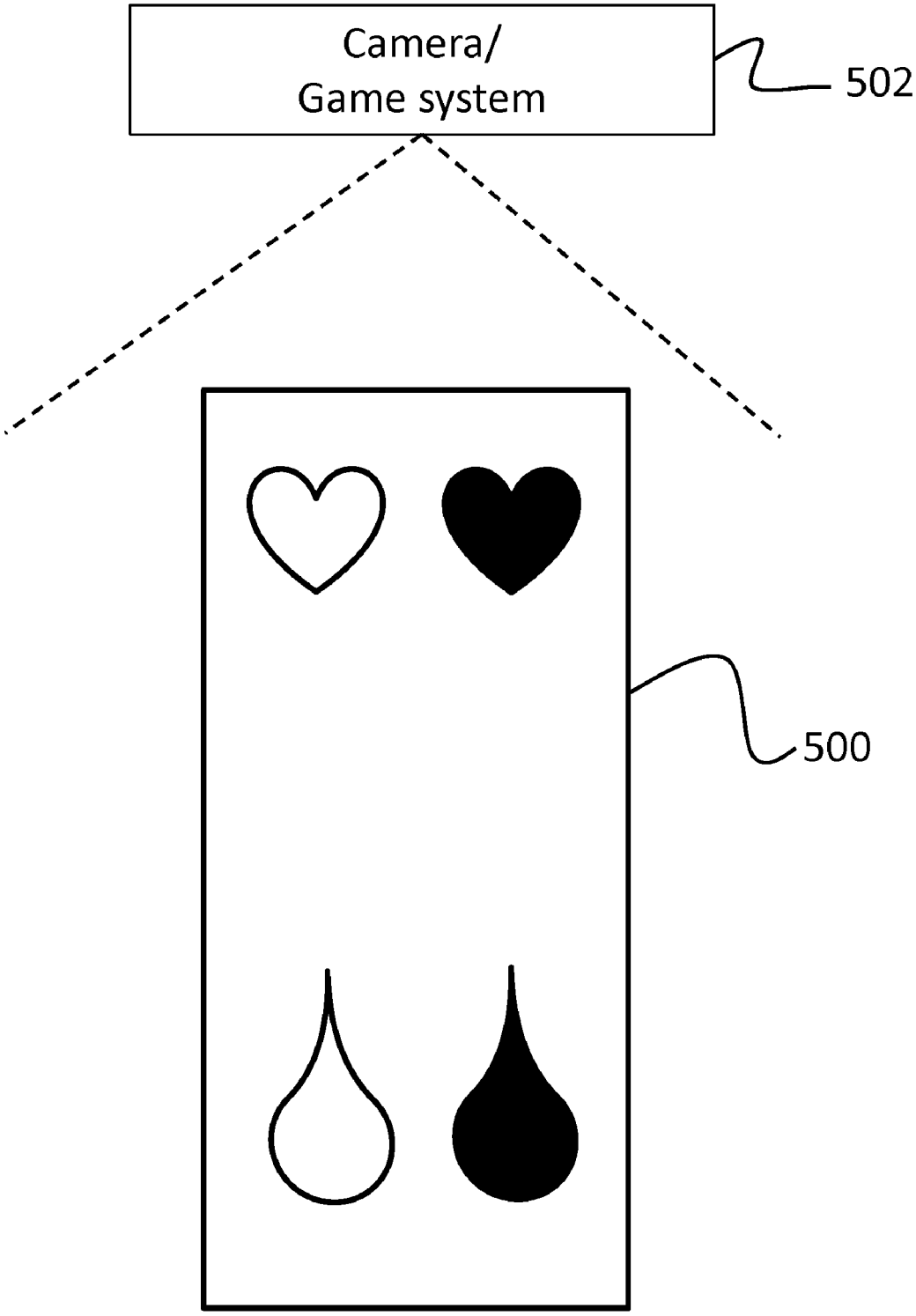
FIG. 5 is an overhead perspective view of mat and a camera/game system according to the present invention.
Figure 6:
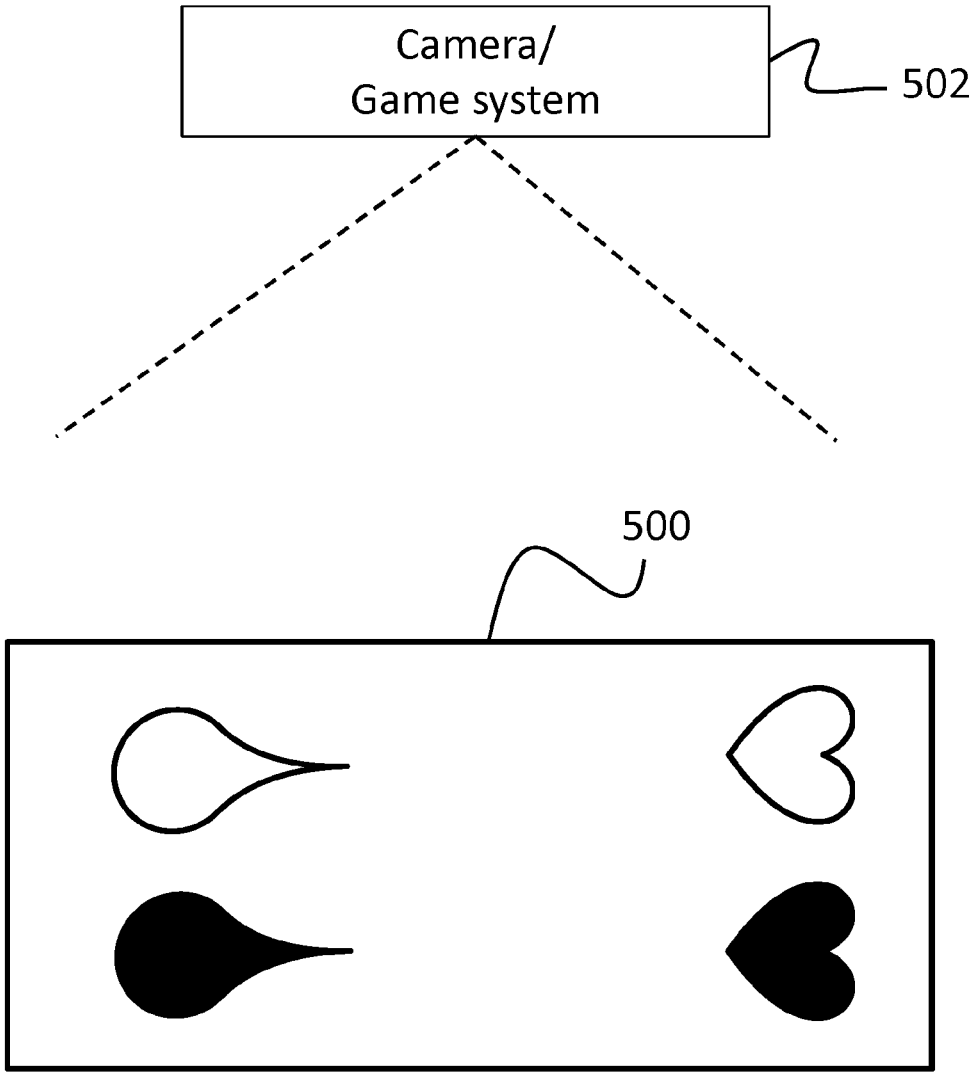
FIG. 6 is an overhead perspective view of mat and a camera/game system according to the present invention.
Figure 7:
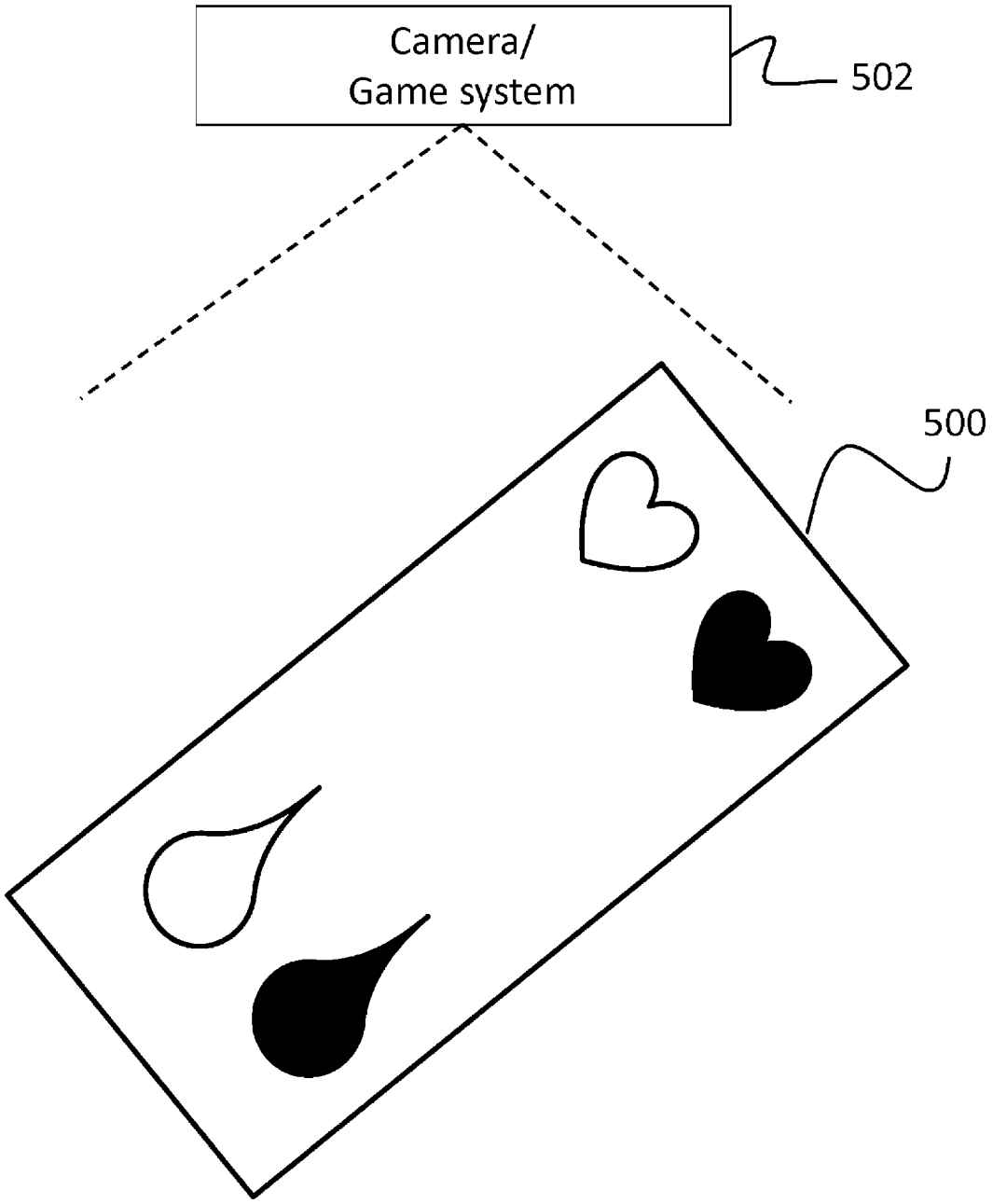
FIG. 7 is an overhead perspective view of mat and a camera/game system according to the present invention.

Location of the mat is important in regards to the depth camera reading postures, and the feedback system. In some cases as in yoga, the mat is more effective facing different locations to read skeletal movement, as those positions depicted in FIGS. 5 through 7. For example, FIG. 5 illustrates a mat 500 positioned in front of a camera/game system 502 such that the mat 500 is completely forward when both feet are facing forward. Alternatively, FIG. 6 depicts the mat 500 positioned at a perpendicular angle (or the top of the mat 500 facing 90 degrees creating a side image) to the media input (e.g., the camera/game system 502). As another example, FIG. 7 illustrates the mat 500 at a 45-degree angle to the camera/game system 502. Thus, the corresponding mat position can be altered depending on exercise and/or game being played, etc. This increases safety, and applies an additional spatial component to building the anatomically correct architecture of the posture(s), thereby increasing physical musclo-skeletal alignment and energetic flow through the body. The computing environment recognizes, analyzes, tracks, and provides correct feedback for postures and movements for the skeletal model and/or energetic flow model based on solid foundational alignment.

Figure 8:
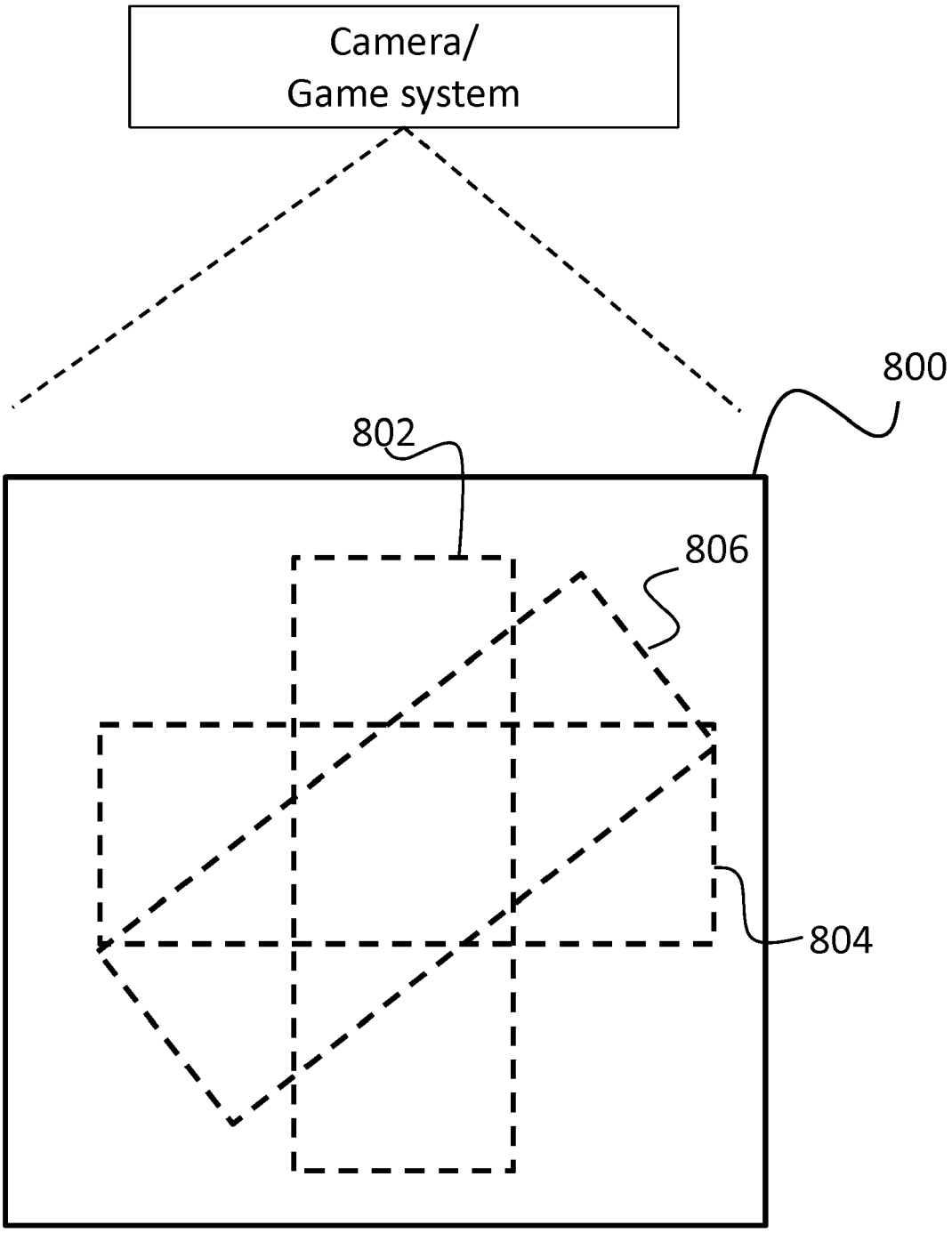
FIG. 8 is an overhead perspective view of mat and a camera/game system according to the present invention.

In another aspect and as depicted in FIG. 8, the mat 800 can be formed as an electronic/high-tech version. In addition to the aspects listed above, the mat 800 may include various changeable indicia to indicate the mat position. As a non-limiting example, the mat 800 can include multiple lights (e.g., LEDs) that light up to illuminate various positions. For example, depicted is a first position 802, a second position 804, and a third position 806. Thus, the mat 800 can use the LEDs or other changeable indicia to indicate (e.g., illuminate) the first position 802. In this aspect, the user would use the first position 802 as illuminated by the mat 800. If the user is playing a different game or participating in an event that desirably uses another position, the mat 800 can selectively indicate the other position, such as the second 804 or third 806 positions.

The mat can also be formed to include a sensor system therein. The sensor system is any suitable mechanism or device (electronic receiver) that is capable of identifying/sensing the location of the user on the mat, non-limiting examples of such sensors include pressure sensors, light sensors, etc. The anthropometric aspect to the device based on bone and spine lengths receives and sends input to the sensor system, and/or sensor system with motion sensor depth camera to adjust the location of the body placement points or symbols in order to best suit each individual physical body.

A mat sensor system may contain a graph system or new technologies for more accurate location reads underneath the symbol location system to accurately determine alignment, growth, efficiency, and improvement. Pressure distribution sensors can read balance, record location of positions using graphics and weight sensors and/or motion sensors.

The Mat and Graphic interpretation of the mat's symbol system through technology may include 2D, 3D, multidimensional image interpretations on the game and media application side, and LED light system and/or 2D or 3D spatial technology system on the mat side.

The mat may also include vital sensors (as understood by one skilled in the art) that can read vital signs determined by technology for weight, heart rate, blood pressure, energetic flow, but not limited to these vital signs or technologies.

Those skilled in the art of movement can set program standards, fitness pros, gamers, new technologists, this is in no way intended to be limiting.

Figure 9:
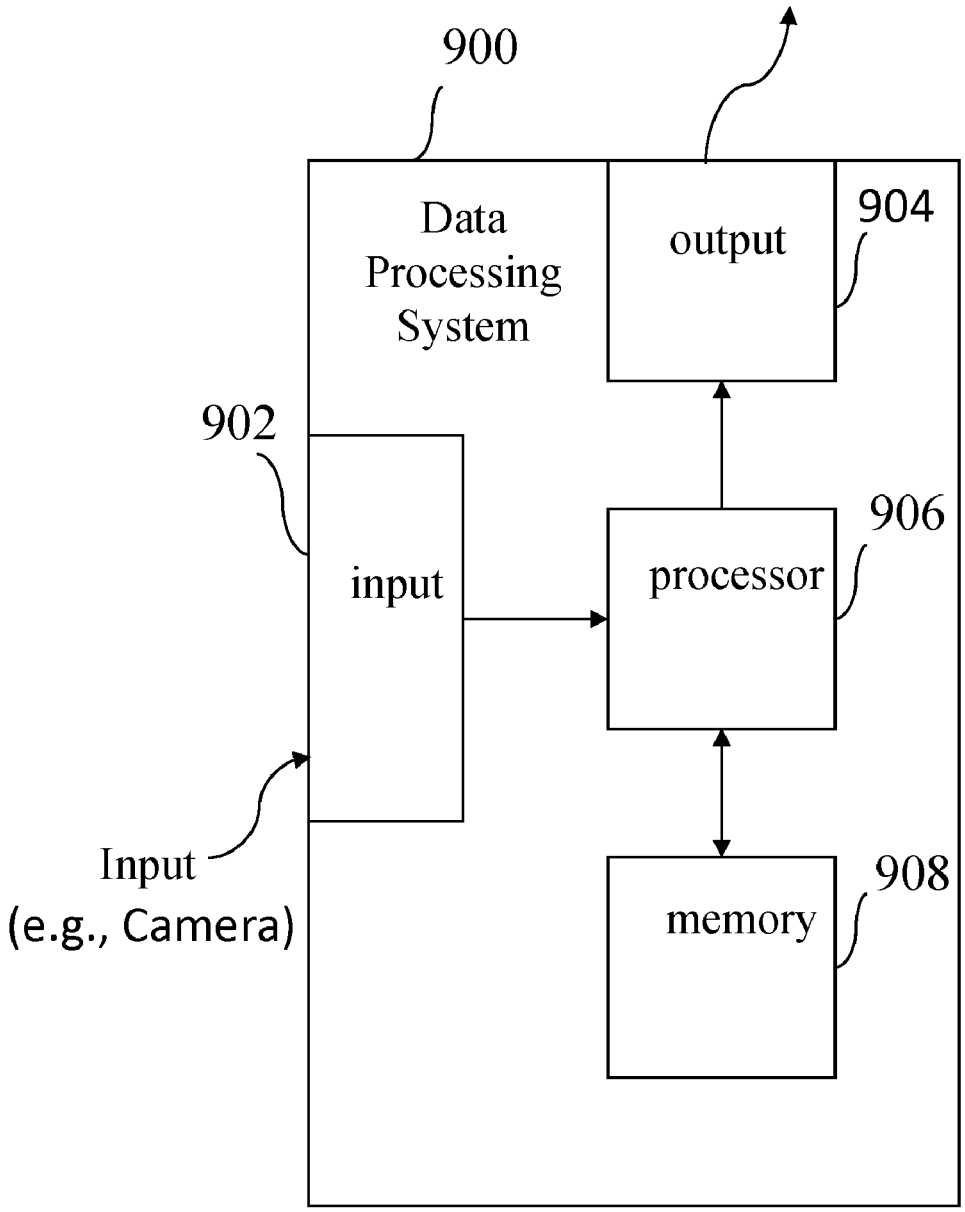
FIG. 9 is a block diagram depicting the components of a camera/games system of the present invention.

It should also be understand that mat can be used with existing camera/game systems (such as the Kinect system by Xbox), or be formed such that present invention also includes such a camera/game system. In this aspect, the camera/game system includes all of the necessary software and/or hardware to enable the electronically facilitated features described herein. For example, FIG. 9 illustrates a block diagram depicting the components of a camera/games system of the present invention. The camera/game system 900 comprises an input 902 for receiving information from at least one sensor for use in detecting the position of a user. Note that the input 902 may include multiple "ports." Typically, input is received from at least one sensor, non-limiting examples of which include video image sensors. An output 904 is connected with the processor for providing information regarding the location of the object to a display or to other systems in order that a network of computer systems may serve as a camera/game system. Output may also be provided to other devices or other programs; e.g., to other software modules, for use therein. The input 902 and the output 904 are both coupled with a processor 906, which may be a general-purpose computer processor or a specialized processor designed specifically for use with the present invention. The processor 906 is coupled with a memory 908 to permit storage of data and software that are to be manipulated by commands to the processor 906.

It should be understood that the motions, posturing, positions, etc. as described herein can be used with an actual mat as depicted and described. However, such motions can also be incorporated into a camera/game system with the mat depicted as a virtual mat that is generated by the camera/game system and depicted on a display. Thus, the user standing in front of the camera/game system is depicted, on the display, as standing on a virtual mat. It should also be noted that the camera/game system can also be formed to illustrate on a display virtual representations of the graphics that are disposed on the top surface of the mat, thereby provide various instructions and responses to and from the user.

Figure 10:
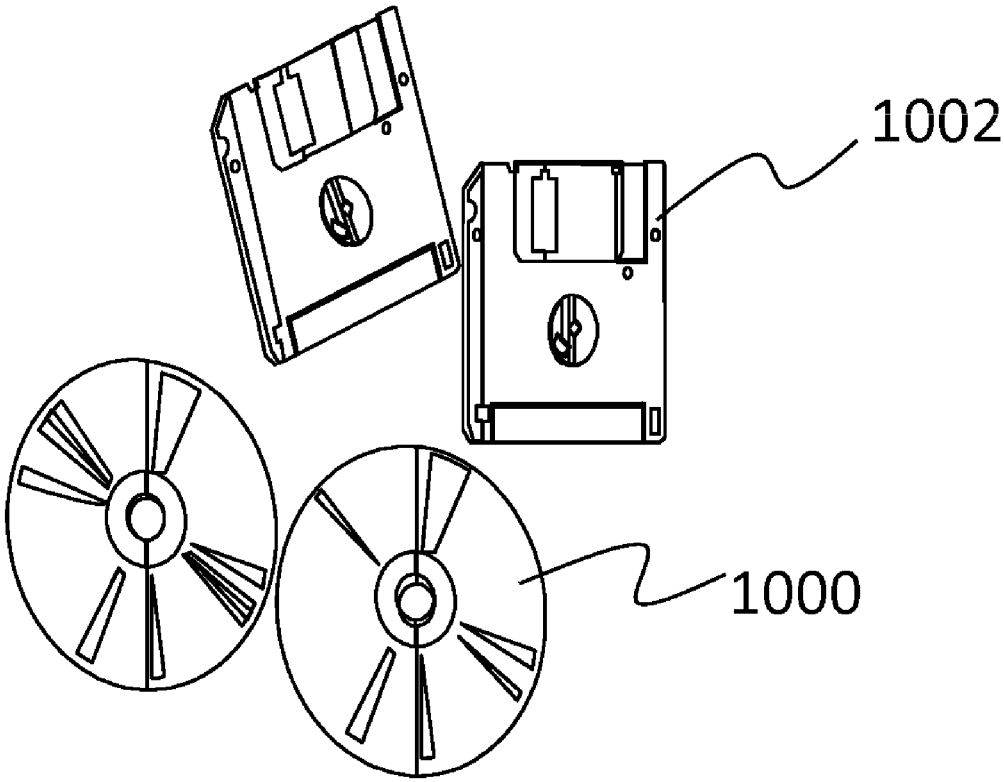
FIG. 10 is an illustration of a computer program product according to the present invention.

Further, the features and functions described herein can be embodied in a computer program product that can be used by a camera/game system (such as that of the present invention or existing systems). An illustrative diagram of a computer program product embodying the present invention is depicted in FIG. 10. The computer program product is depicted as an optical disk 1000 such as a CD or DVD or floppy disk 1002, or any other suitable medium such as downloadable content, or live content through the interne or networks. However, the computer program product generally represents computer-readable instruction means stored on any compatible non-transitory computer-readable medium. The term "instruction means" as used with respect to this invention generally indicates a set of operations to be performed on a computer, and may represent pieces of a whole program or individual, separable, software modules. Non-limiting examples of "instruction means" include computer program code (source or object code) and "hard-coded" electronics (i.e. computer operations coded into a computer chip). As noted above, the "instruction means" may be stored in the memory of a computer or on a non-transitory computer-readable medium such as a floppy disk, a CD-ROM, and a flash drive.

While all above-mentioned embodiments describe possible configurations of various systems and methods of the present invention, it is understood that they are included for illustrative and instructive purposes and are not included to limit the scope of the present invention.

Although the present invention has been described in considerable detail with reference to certain preferred configurations thereof, other versions are possible. The graphics/symbols, arrangement of graphics/symbols, and/or dimensions can be varied or altered to create any number of varying design patterns and mats/cushions suited to any size or variety of users. Furthermore, the mats/cushions can be interactively used in many different settings with any combination of multimedia. Accordingly, the spirit and scope of the invention should not be limited to the versions of the invention described above.

What is claimed is:

1. An interactive physical exercise device comprising:

a mat with a top surface, wherein the mat is an actual mat or a virtual mat that is generated and depicted on a display;

a plurality of graphics disposed or depicted on said top surface, said graphics specifically arranged to assist with proper body placement and alignment;

an interactive system for instructing on proper use of said graphics; and/or a virtual representation of said graphics; and wherein said plurality of graphics are arranged to coincide with body symmetry and anatomy averages of anthropometric body measurements of a user.

2. The physical exercise device of claim 1, wherein the anatomy averages of anthropometric body measurements of a user include but are not limited to spine length, shoulder and hip widths, hand and foot lengths and spreads, appendage lengths, or body heights.

3. The physical exercise device of claim 1, wherein said anthropometrically-arranged graphics provide a map and guide for proper placement of at least one of hands, elbows, forearms, knees, feet, seat bones, sacrum, belly, head, fingers and finger pads, heels of hands, toes, heel, ball of the feet, and any combination thereof for facilitating effective body positions for alignment, rehabilitation, balance, growth, or posture.

4. The physical exercise device of claim 1, wherein said graphics comprise recognizable symbols or characters to instruct users in proper body placement based on symbol locations.

5. The physical exercise device of claim 1, wherein said anthropometrically-arranged graphics are ergonomically correct so as to increase safety and prevent injury.

6. The physical exercise device of claim 1, wherein said graphics are arranged to support proper positioning and guidance for multiple forms of physical exercise, selected from a group consisting of yoga, martial arts forms and stances, interactive play, dance steps, reflex training, cheerleading, running, hopping, jumping, cardio programs, muscle and body sculpting, resistance techniques, creative movement games, physical therapy, breath and meditation techniques or mental focus games.

7. The physical exercise device of claim 1, wherein said interactive system comprises instruction through one or more of audio, video displays, games or video games comprising graphics corresponding to those on said mat, said instruction delivered by one or more of auditory, visual, or other interactive multimedia systems comprising videos, gaming systems, or the internet.

8. The physical exercise device of claim 7, wherein said interactive systems, in conjunction with said mat graphics, guide users through sequences of poses or movements to teach proper techniques for a variety of physical exercises.

9. The physical exercise device of claim 1, wherein said interactive systems comprises instructional material delivered through one or more of teaching, live means, recording, text, voice, workbooks, print, lyrics, music, video, multimedia, games, video games, graphics, animation, networks or the internet.

10. The physical exercise device of claim 1, wherein said mat is multi-user and may comprise: two separate mats with identical symbols; one mat with two sets of symbols; or, one mat with more than two sets of symbols.

11. An interactive physical exercise system comprising:

a mat with a top surface and a bottom surface;

a plurality of indicia disposed on said top surface, said indicia specifically arranged to assist with proper body placement and alignment;

electronic receivers disposed within said mat for detecting movement on or weight applied to said indicia and said top surface of said mat;

an apparatus for interacting with said electronic receivers and providing feedback for proper use of said mat; and wherein said plurality of indicia are arranged to coincide with body symmetry and anatomy averages of anthropometric body measurements of a user.

12. The interactive physical exercise system of claim 11, wherein said system may be used as or with peripheral gaming consoles, an MMO plug-in, a tool in interactive classes, cell phone technology, the internet, or social networks.

13. The interactive physical exercise system of claim 11, wherein said electronic receivers and said apparatus interact to synchronize physical exercise and movement programs through interactive multimedia, music, or other entertainment.

14. The interactive physical exercise system of claim 11, further comprising voice or personal trainer guidance to correct postures based on body measurements including but not limited to height and weight, weight distribution, heart rate, length and timing of posture held, or timing of breath.

15. The interactive physical exercise system of claim 11, wherein said system is networked for teacher/student interaction, multiple users, or personalized generation of exercise programs or routines.

16. An interactive physical exercise system comprising:

a mat with a top surface and a bottom surface;

a plurality of indicia disposed on said top surface, said indicia specifically arranged to assist with proper body placement and alignment, electronic receivers disposed within said mat for detecting movement on or weight applied to said indicia and said top surface of said mat;

an apparatus for interacting with said electronic receivers and providing feedback for proper use of said mat; and wherein said electronic receivers further comprises sensors placed in or on said mat at said plurality of indicia, said sensors calculating a user's weight or anthropometrically evaluating a user's body.

17. The interactive physical exercise system of claim 16, wherein said sensors provide biofeedback to a user to support one or more of proper balance, alignment, weight distribution, directional movement, or posture while performing various poses, sequences, exercise routines or other movements.

18. The interactive physical exercise system of claim 16, wherein said sensors provide feedback on biorhythms and other body functions to assist with proper breathing, heart rate, or mental focus.

19. The interactive physical exercise system of claim 16, wherein said sensors provide information to enable holographic images, virtual images, or projections of the user while on the mat.

* * * * *